US009263825B2

(12) United States Patent
Ito

(10) Patent No.: US 9,263,825 B2
(45) Date of Patent: Feb. 16, 2016

(54) ELECTRIC WIRE TERMINAL CONNECTION STRUCTURE AND INTERMEDIARY CAP USED FOR THE SAME

(71) Applicant: YAZAKI CORPORATION, Minato-ku, Tokyo (JP)

(72) Inventor: Naoki Ito, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 10 days.

(21) Appl. No.: 14/255,213

(22) Filed: Apr. 17, 2014

(65) Prior Publication Data

US 2014/0224536 A1 Aug. 14, 2014

Related U.S. Application Data

(63) Continuation of application No. PCT/JP2012/006740, filed on Oct. 22, 2012.

(30) Foreign Application Priority Data

Oct. 27, 2011 (JP) ..... 2011-235705

(51) Int. Cl.
*H01R 13/533* (2006.01)
*H01R 4/18* (2006.01)
(Continued)

(52) U.S. Cl.
CPC ..... *H01R 13/533* (2013.01); *H01R 4/18* (2013.01); *H01R 4/184* (2013.01); *H01R 4/20* (2013.01); *H01R 4/62* (2013.01)

(58) Field of Classification Search
CPC ..... H01R 9/05; H01R 11/11; H01R 13/03; H01R 13/04; H01R 13/52; H01R 13/533; H01R 13/5205; H01R 13/113; H01R 4/18; H01R 4/20; H01R 4/22; H01R 4/62; H01R 4/70; H01R 4/72; H01R 4/184; H01R 4/183; H01R 4/187; H01R 4/188; H01R 4/185; H01R 4/58; H01R 4/206; H01R 4/625; H01R 43/0207; H01R 43/005; H01R 43/16; H02G 1/14; C23C 28/023; C23C 28/021; C23C 28/025; C23C 24/04; Y10T 29/49192
USPC ..... 174/84 C, 74 R, 19; 439/271, 882, 877, 439/879; 427/123; 29/867
See application file for complete search history.

(56) References Cited

U.S. PATENT DOCUMENTS 5,496,968 A * 3/1996 Katoh et al. ..... 174/74 R
6,933,442 B2 * 8/2005 Franks, Jr. ..... 174/51
(Continued)

FOREIGN PATENT DOCUMENTS

FR 1099263 A 9/1955
FR 10099263 A 9/1955
(Continued)

OTHER PUBLICATIONS

Different Types of Corrosion-Recognition, Mechanisms & Prevention, Oct. 18, 2011; Internet Archive WayBackMachine.*
(Continued)

*Primary Examiner* — Timothy Thompson
*Assistant Examiner* — Guillermo Egoavil
(74) *Attorney, Agent, or Firm* — Mots Law, PLLC

(57) ABSTRACT

An electric wire terminal connection structure includes an electric wire including a core made of a metallic material and an insulation layer covering the core, a terminal fitting attached to a terminal of the electric wire and made of a metallic material other than the metallic material of the core, and an intermediary cap to be crimped to the core by the terminal fitting and to cover an exposed portion of the core exposed by removing the insulation layer at the terminal of the electric wire. The intermediary cap has conductivity and is made of a metallic material having a value of a standard electrode potential between that of the core and that of the terminal fitting.

16 Claims, 5 Drawing Sheets

(51) Int. Cl.
*H01R 4/20* (2006.01)
*H01R 4/62* (2006.01)

(56) References Cited

U.S. PATENT DOCUMENTS

| | | | | |
|---|---|---|---|---|
| 2013/0072075 | A1* | 3/2013 | Kayamoto | C23C 24/04 439/887 |
| 2014/0162505 | A1* | 6/2014 | Ohnuma | H01R 13/03 439/877 |

FOREIGN PATENT DOCUMENTS

| | | | |
|---|---|---|---|
| GB | 1164100 | A | 9/1969 |
| JP | 2003-229183 | A | 8/2003 |
| JP | 2004207172 | A | 7/2004 |
| JP | 2007311369 | A | 11/2007 |
| JP | 2011-192586 | A | 9/2011 |
| JP | 2011-204440 | A | 10/2011 |
| WO | WO2004047227 | A1 | 6/2004 |
| WO | 2011115005 | A1 | 9/2011 |

OTHER PUBLICATIONS

Electrode Potential and Galvanic Corrosion, Oct. 5, 2011; Internet Archive WayBackMachine.*
The Japanese office action letter issued on Apr. 22, 2015 in the counterpart Japanese patent application.
The Chinese office action letter issued on Aug. 6, 2015 in the counterpart Chinese patent application.
The Japanese of action letter issued on Jun. 30, 2015 in the counterpart Japanese patent application.
The Japanese office action letter issued on Jun. 30, 2015 in the counterpart Japanese patent application.
The Korean office action letter issued on Aug. 18, 2015 in the counterpart Korean patent application.

* cited by examiner

ELECTRIC WIRE TERMINAL CONNECTION STRUCTURE AND INTERMEDIARY CAP USED FOR THE SAME

CROSS REFERENCE TO RELATED APPLICATION

This application is a Continuation of PCT Application No. PCT/JP2012/006740, filed on Oct. 22, 2012, and claims the priority of Japanese Patent Application No. 2011-235705, filed on Oct. 27, 2011, the content of both of which is incorporated herein by reference.

BACKGROUND

1. Technical Field

The present invention relates to an electric wire terminal connection structure used for automobiles and the like and also relates to an intermediary cap used for the electric wire terminal connection structure.

2. Related Art

Generally, an open-barrel type terminal fitting having an electric wire connection portion formed by uplifting crimp pieces from both side edges of a bottom plate is mounted to a terminal of an electric wire used for automobiles and the like. It is known that, when a core covered with an insulation layer of this electric wire is made of a metal different from a metal of the terminal fitting, a water content such as dew formation which may intervene in a portion for connecting the core and the terminal fitting causes an electric corrosion which is a phenomenon that a corrosion progresses by an electrochemical reaction attributable to both metals melted as ion into water.

Then, Japanese Unexamined Patent Publication No. 2007-311369 proposes an electric wire terminal connection structure having such a structure that, for preventing entry of the water content, an intermediary cap is covered over a core of an electric wire and a crimp piece is so crimped as to surround the intermediary cap. In this electric wire terminal connection structure, the intermediary cap is made of the same type of metal (for example, copper alloy) as that of metal of a terminal fitting, thus enabling to prevent occurrence of the electric corrosion which may be caused between the intermediary cap and the terminal fitting.

SUMMARY

However, it is necessary for the above electric wire terminal connection structure to further provide a waterproof measure such as filling material and rubber plug between the core and the intermediary cap so as to prevent the electric corrosion between the core and the intermediary cap. As a result, the above electric wire terminal connection structure should have the increased number of component parts, thus increasing the production cost.

It is an object of the present invention to provide an electric wire terminal connection structure capable of suppressing an electric corrosion between a core and an intermediary cap without causing an increase in production cost and to provide the intermediary cap used for the electric wire terminal connection structure.

A first aspect of the present invention is an electric wire terminal connection structure including an electric wire comprising a core made of a metallic material and an insulation layer covering the core, a terminal fitting configured to be attached to a terminal of the electric wire and made of a metallic material other than the metallic material of the core, and an intermediary cap configured to be crimped to the core by the terminal fitting and to cover an exposed portion of the core exposed by removing the insulation layer at the terminal of the electric wire, the intermediary cap having conductivity and made of a metallic material having a value of a standard electrode potential between a value of a standard electrode potential of the core and a value of a standard electrode potential of the terminal fitting.

According to the first aspect, the intermediary cap has the conductivity and is made of the metallic material having the value of a standard electrode potential between the value of the standard electrode potential of the core and the value of the standard electrode potential of the terminal fitting. This accomplishes that the potential difference, based on the standard electrode potential, between the core and the intermediary cap can be made smaller than the potential difference, based on the standard electrode potential, between the conventional core and the conventional intermediary cap which is made of the same type of metal as that of metal of the conventional terminal fitting. In addition, this accomplishes that the potential difference, based on the standard electrode potential, between the intermediary cap and the terminal fitting can be also made smaller than the potential difference, based on the standard electrode potential, between the conventional intermediary cap and the conventional terminal fitting.

By this, the progress of the electric corrosion (local cell) caused by the core reacted with the intermediary cap by the water content can be more delayed than the progress of the electric corrosion between the conventional core and the conventional intermediary cap. Further, the progress of the electric corrosion caused between the intermediary cap and the terminal fitting can be more delayed than the progress of the electric corrosion between the conventional intermediary cap and the conventional terminal fitting. That is, by the above structure, the progress of the electric corrosion can be delayed to thereby accomplish a longer life, without making such a large local cell as conventionally shown. Thus, without the need of the water-proof measure such as rubber plug and filling material, the electric corrosion between the core and the intermediary cap as well as the electric corrosion between the intermediary cap and the terminal fitting can be suppressed, thus enabling to reduce the production cost.

The core may be made of aluminum or aluminum alloy, the terminal fitting may be made of copper or copper alloy, and the intermediary cap may be made of tin or tin alloy.

According to the above structure, the intermediary cap is made of tin or tin alloy. This suppresses the electric corrosion between the core and the intermediary cap and meanwhile using such a relatively low-cost metallic material can reduce the production cost.

The intermediary cap may include a core covering portion configured to cover the exposed portion of the core, and an insulation layer covering portion configured to cover the insulation layer.

According to the above structure, the intermediary cap is provided with the insulation layer covering portion. That is, the intermediary cap reaches as far as the insulation layer. With this construction, compared with a case in which the intermediary cap does not reach the insulation layer, the intermediary cap is more likely to shut off between the core and the terminal fitting, thus hardly causing a large local cell.

A second aspect of the present invention is an intermediary cap including a core covering portion configured to cover an exposed portion of a core of an electric wire, the electric wire including the core made of a metallic material and an insulation layer covering the core, the exposed portion of the core being exposed by removing the insulation layer at a terminal of the electric wire, and an insulation layer covering portion configured to cover the insulation layer of the electric wire. The intermediary cap is configured to be crimped to the core by a terminal fitting configured to be attached to the terminal of the electric wire and made of a metallic material other than the metallic material of the core. The intermediary cap has conductivity. The intermediary cap is made of a metallic material having a value of a standard electrode potential between a value of a standard electrode potential of the core and a value of a standard electrode potential of the terminal fitting.

According to the second aspect, it is possible to produce effects similar to the first aspect.

DETAILED DESCRIPTION

Figure 1:
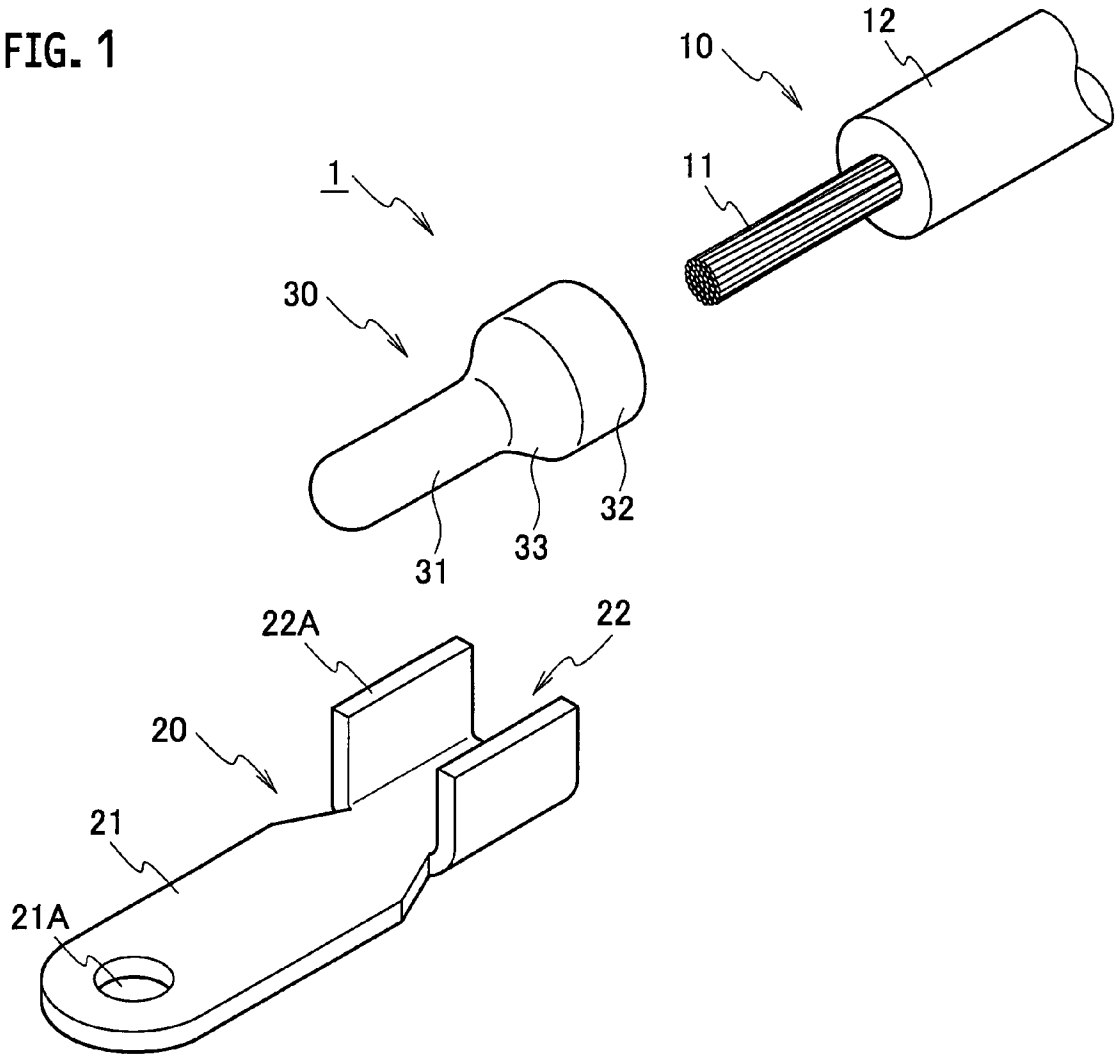
FIG. 1 is an exploded perspective view showing an electric wire terminal connection structure according to an embodiment.

An explanation will be made, with reference to the drawings, about an electric wire terminal connection structure according to an embodiment of the present invention. Specifically, the explanation will be made about (1) structure of the electric wire terminal connection structure, (2) a method of mounting an intermediary cap, (3) operations and effects, and (4) other embodiments.

In the description of the following drawings, the same or similar reference numerals or signs will be added to the same or similar portions. However, it should be noted that the drawings are schematic and ratios and the like of individual dimensions are different from those of actual ones.

Thus, specific dimensions and the like should be determined, referring to the following explanations. Further, there may be included portions having different dimensional relations or different dimensional ratios between the drawings.

(1) Configuration of Electric Wire Terminal Connection Structure

Figure 2:
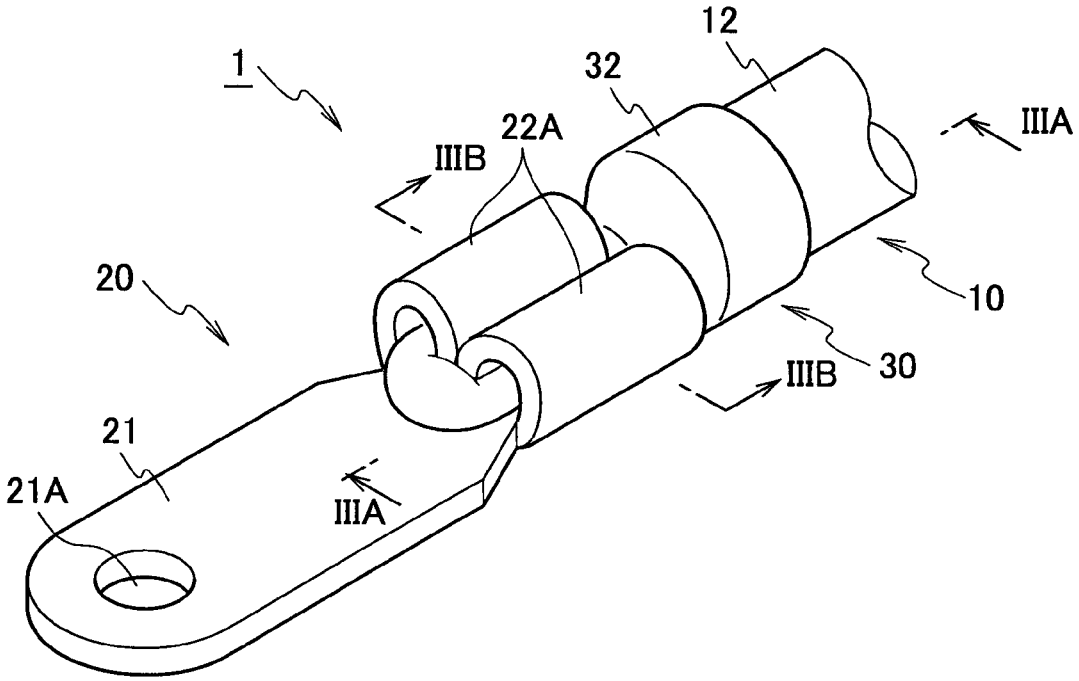
FIG. 2 is a perspective view of the assembled electric wire terminal connection structure according to the embodiment.
Figure 3A:
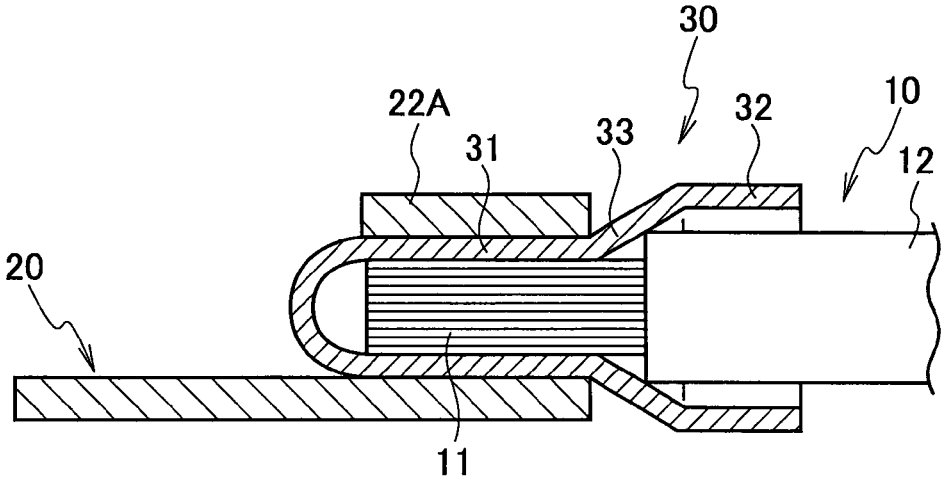
FIG. 3A is a cross sectional view taken along the line IIIA-IIIA in FIG. 2 showing a longitudinal direction of an electric wire of the electric wire terminal connection structure according to the embodiment.
Figure 3B:
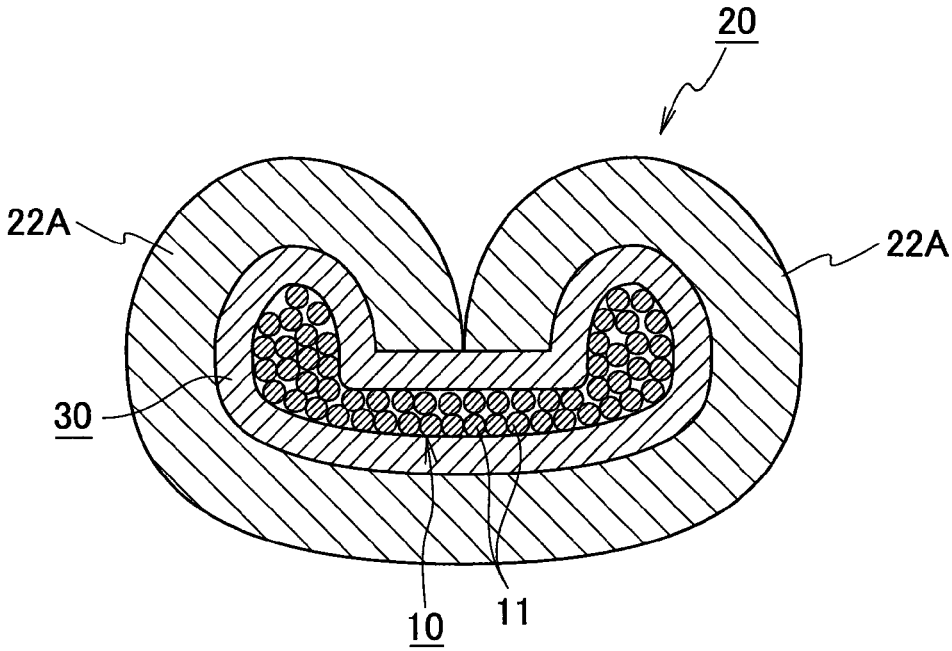
FIG. 3B is a cross sectional view taken along the line IIIB-IIIB in FIG. 2 showing a lateral direction of the electric wire of the electric wire terminal connection structure according to the embodiment.
Figure 4:
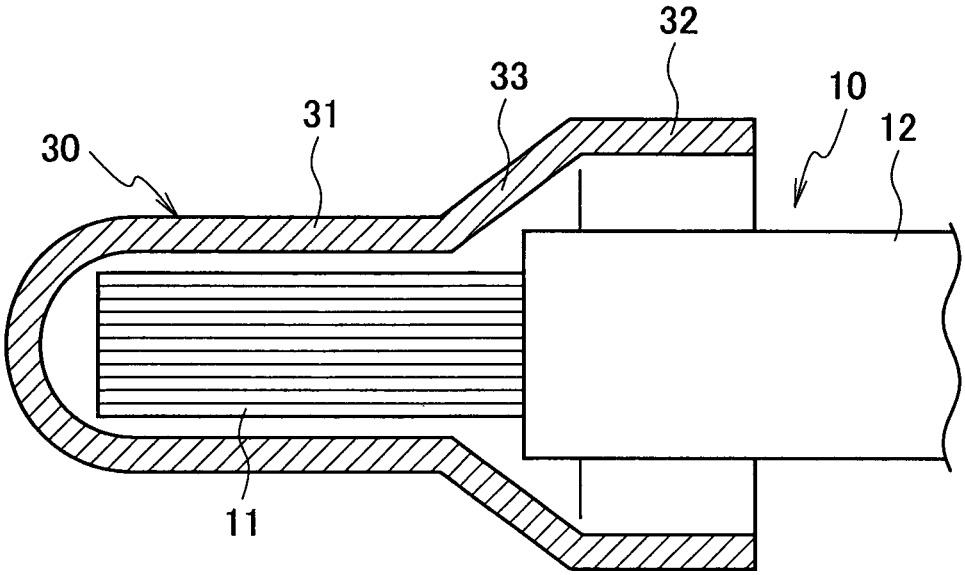
FIG. 4 is a cross sectional view showing only the electric wire and an intermediary cap according to the embodiment.

First, referring to the drawings, an explanation will be made about the structure of an electric wire terminal connection structure 1 according to the embodiment. FIG. 1 is an exploded perspective view showing the electric wire terminal connection structure 1 according to the embodiment. FIG. 2 is a perspective view of the assembled electric wire terminal connection structure 1 according to the embodiment. FIG. 3A is a cross sectional view showing a longitudinal direction of an electric wire of the electric wire terminal connection structure 1 according to the embodiment (a cross sectional view taken along the line IIIA-IIIA in FIG. 2), and FIG. 3B is across sectional view showing a lateral direction of the electric wire of the electric wire terminal connection structure 1 according to the embodiment (a cross sectional view taken along the line IIIB-IIIB in FIG. 2). FIG. 4 is a cross sectional view showing only an electric wire 10 and an intermediary cap 30 according to the embodiment.

As shown in FIG. 1 to FIG. 3B, the electric wire terminal connection structure 1 is used for automobiles and the like. The electric wire terminal connection structure 1 is provided with the electric wire 10, a terminal fitting 20 and the intermediary cap 30.

The electric wire 10 includes a core 11 made of a metallic material such as aluminum or aluminum alloy and an insulation layer 12 made of resin and configured to cover the core 11. At a terminal of the electric wire 10, the core 11 is exposed by removing (stripping off) apart of the insulation layer 12. The terminal fitting 20 is mounted to the terminal, on the thus exposed core 11 side, of the electric wire 10.

The terminal fitting 20 is made of a metallic material different from the metallic material of the core 11. According to the embodiment, the terminal fitting 20 is made of copper or copper alloy. As a whole, the terminal fitting 20 is thin and has an elongated configuration in the longitudinal direction of the electric wire 10. Specifically, the terminal fitting 20 is provided with a device connecting portion 21 at its front end and an open-barrel type electric wire crimp portion 22 formed by uplifting a crimp piece 22A from either side edge of a bottom plate. The device connecting portion 21 is formed with a connection hole 21A, while the electric wire crimp portion 22 is conductively connected with the core 11 by way of the intermediary cap 30.

The intermediary cap 30 is configured to be crimped to the core 11 with the terminal fitting 20 and to cover an exposed portion of the core 11, exposed by removing the insulation layer 12 at the terminal of the electric wire 10 (refer to FIG. 2 and FIGS. 3A and 3B). The intermediary cap 30 has conductivity and is made of a metallic material having a value of a standard electrode potential between a value of a standard electrode potential of the core 11 and a value of a standard electrode potential of the terminal fitting 20. According to the embodiment, the intermediary cap 30 is made of tin or tin alloy.

The intermediary cap 30 is, as shown in FIG. 1 and FIG. 4, formed into a cylinder with its distal end side closed and is formed in such a manner as to cover a range from the core 11 of the electric wire 10 to a part of the insulation layer 12 of the electric wire 10. Specifically, the intermediary cap 30 is provided with a core covering portion 31 for covering the core 11 and an insulation layer covering portion 32 for covering the insulation layer 12.

A multilevel portion 33 having a diameter gradually enlarged from the core covering portion 31 toward the insulation layer covering portion 32 is formed between the core covering portion 31 and the insulation layer covering portion 32. The core covering portion 31 has a diameter smaller than the diameter of the insulation layer covering portion 32, and the insulation layer covering portion 32 has a diameter larger than the diameter of the core covering portion 31.

(2) Method of Mounting Intermediary Cap 30

Figure 5A:
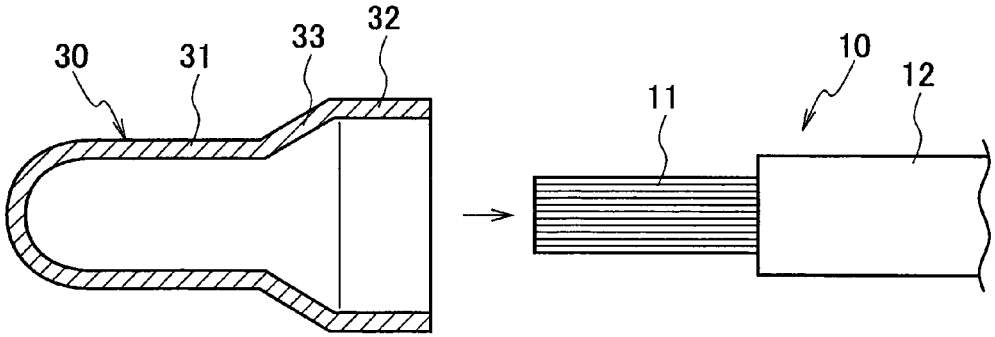
FIGS. 5A to 5C are cross sectional views for explaining a method of mounting the intermediary cap according to the embodiment.
Figure 5B:
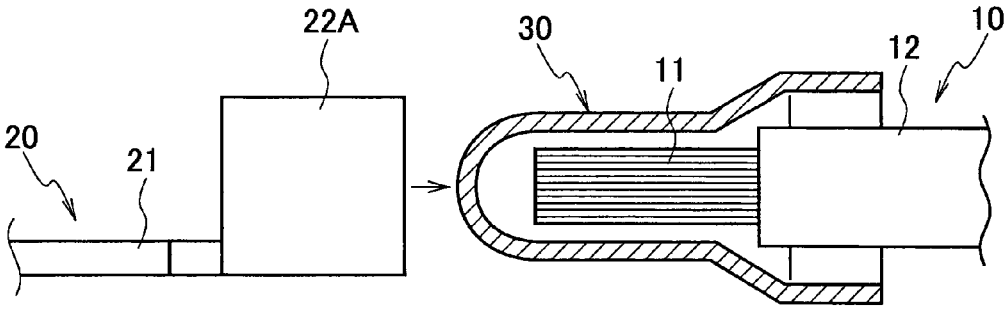
Figure 5C:
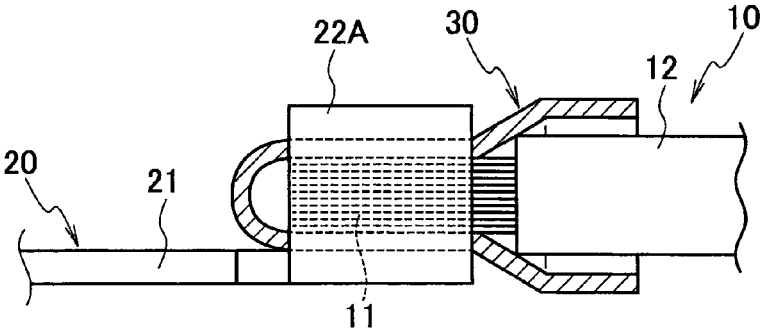

Next, a method of mounting the above-described intermediary cap 30 to the terminal of the electric wire 10 will be explained with reference to the drawings. FIGS. 5A to 5C are cross sectional views for explaining the method of mounting the intermediary cap 30 according to the embodiment.

As shown in FIG. 5A and FIG. 5B, the intermediary cap 30 is fitted to the terminal of the electric wire 10. By this operation, the exposed portion of the core 11 exposed by removing the insulation layer 12 and a part of the insulation layer 12 are covered with the intermediary cap 30.

Next, as shown in FIG. 5B and FIG. 5C, the terminal fitting 20 is mounted to the intermediary cap 30, and the crimp piece 22A is crimped in such a manner as to surround the intermediary cap 30, to thereby crimp the intermediary cap 30 to the terminal of the electric wire 10. By this operation, the core 11 and the terminal fitting 20 are made electrically conductive with each other by way of the intermediary cap 30, to thereby conductively connecting the electric wire 10 with the terminal fitting 20.

(3) Operations And Effects

Generally, the aluminum (core 11) and the copper (terminal fitting 20) have a potential difference, based on the standard electrode potential, of about 2.016 V. That is, getting the aluminum and the copper to have a contact with each other causes the great potential difference based on the standard electrode potential, thus causing a larger local cell.

In view of the above, according to the embodiment, for hardly causing the larger local cell, the above combination of the aluminum and the copper is avoided. That is, according to the embodiment, bringing the aluminum (core 11) and the tin (intermediary cap 30) into contact with each other causes the potential difference, based on the standard electrode potential, to be about 1.538 V. Further, bringing the copper (terminal fitting 20) and the tin (intermediary cap 30) into contact with each other causes the potential difference, based on the standard electrode potential, to be about 0.48 V.

As set forth above, according to the embodiment, avoiding the combination of the aluminum and the copper can minimize the potential difference based on the standard electrode potential, thus enabling to suppress the electric corrosion between the core 11 and the intermediary cap 30. As a result, the progress of the corrosion can be delayed, and the reliability of conductivity between the core 11 and the terminal fitting 20 can be improved.

Specifically, according to the embodiment, the intermediary cap 30 has the conductivity and is made of the metallic material having the value of the standard electrode potential between the value of the standard electrode potential of the core 11 and the value of the standard electrode potential of the terminal fitting 20. This accomplishes that the potential difference, based on the standard electrode potential, between the core 11 and the intermediary cap 30 can be made smaller than the potential difference, based on the standard electrode potential, between the conventional core and the conventional intermediary cap which is made of the same type of metal as that of metal of the conventional terminal fitting. In addition, this accomplishes that the potential difference, based on the standard electrode potential, between the intermediary cap 30 and the terminal fitting 20 can be also made smaller than the potential difference, based on the standard electrode potential, between the conventional intermediary cap and the conventional terminal fitting.

By this, the progress of the electric corrosion (local cell) caused between the core 11 and the intermediary cap 30 reacted therewith by the water content can be more delayed than the progress of the electric corrosion between the conventional core and the conventional intermediary cap. Further, the progress of the electric corrosion between the intermediary cap 30 and the terminal fitting can be more delayed than the progress of the electric corrosion between the conventional intermediary cap and the conventional terminal fitting. That is, by the above structure according to the present invention, the progress of the electric corrosion can be delayed to thereby accomplish a longer life, without making such a large local cell as conventionally shown. Thus, without the need of the water-proof measure such as rubber plug and filling material, the electric corrosion between the core 11 and the intermediary cap 30 as well as the electric corrosion between the intermediary cap 30 and the terminal fitting 20 can be suppressed, thus enabling to reduce the production cost.

According to the embodiment, the intermediary cap 30 is made of tin or tin alloy. This suppresses the electric corrosion between the core 11 and the intermediary cap 30 and meanwhile using such a relatively low-cost metallic material can reduce the production cost.

According to the embodiment, the intermediary cap 30 is provided with the insulation layer covering portion 32. That is, the intermediary cap 30 reaches as far as the insulation layer 12. With this construction, compared with a case in which the intermediary cap 30 does not reach the insulation layer 12, the intermediary cap 30 is more likely to shut off between the core 11 and the terminal fitting 20, thus hardly causing the large local cell.

(4) Other Embodiments

As set forth above, although the contents of the present invention have been disclosed through the embodiment of the present invention, the descriptions and drawings constituting a part of the disclosure should not be interpreted to limit the present invention. From this disclosure, various alternative embodiments, examples and operational technologies become obvious to a person skilled in the art.

For example, the embodiment of the present invention can be varied in the following manner. Specifically, it has been explained that the intermediary cap 30 is made of tin or tin alloy. However, not limited to this, the intermediary cap 30 may be made of another metallic material provided that such metallic material has a value of the standard electrode potential between the value of the standard electrode potential of the core 11 and the value of the standard electrode potential of the terminal fitting 20.

For example, the intermediary cap 30 may be made of iron or iron alloy, nickel or nickel alloy, zinc or zinc alloy, or the like. Further, concerning the core 11, the aluminum or aluminum alloy is not a must. Likewise, concerning the terminal fitting 20, copper or copper alloy is not a must.

Further, it has been explained that the multilevel portion 33 of the intermediary cap 30 has the diameter gradually enlarged from the core covering portion 31 toward the insulation layer covering portion 32. However, not limited to this, the multilevel portion 33 of the intermediary cap 30 may be provided to be orthogonal to the core covering portion 31 and the insulation layer covering portion 32.

Further, it is preferable that the insulation layer covering portion 32 be as long as possible in the longitudinal direction of the electric wire 10 so as to make the dew formation hardly enter. In addition, it is not necessary that the insulation layer covering portion 32 cover the insulation layer 12 provided that the insulation layer covering portion 32 reaches the insulation layer 12. Further, providing the insulation layer covering portion 32 is not a must, that is, the multilevel portion 33 or the like may reach the insulation layer 12.

The features of the present invention can provide the electric wire terminal connection structure capable of suppressing the electric corrosion between the core and the intermediary cap without causing an increase in production cost and can provide the intermediary cap used for the electric wire terminal connection structure.

In this way, as a matter of course, the present invention includes various embodiments and the like which are not described herein. Thus, the technical scope of the present invention can be defined only by the inventive specific matters within a proper scope of claims from the above explanation.

What is claimed is:

1. An electric wire terminal connection structure comprising:

an electric wire comprising a core made of a metallic material and an insulation layer covering the core;

a terminal fitting configured to be attached to a terminal of the electric wire and made of a metallic material other than the metallic material of the core; and an intermediary cap configured to be crimped to the core without a water-proof measure between the intermediary cap and the core by the terminal fitting and to cover an exposed portion of the core exposed by removing the insulation layer at the terminal of the electric wire, the intermediary cap having conductivity and made of a metallic material having a value of a standard electrode potential between a value of a standard electrode potential of the core and a value of a standard electrode potential of the terminal fitting.

2. The electric wire terminal connection structure according to claim 1, wherein the core is made of aluminum or aluminum alloy, the terminal fitting is made of copper or copper alloy, and the intermediary cap is made of tin or tin alloy.

3. The electric wire terminal connection structure according to claim 1, wherein the intermediary cap comprises:

a core covering portion configured to cover the exposed portion of the core; and an insulation layer covering portion configured to cover the insulation layer.

4. An intermediary cap comprising:

a core covering portion configured to cover an exposed portion of a core of an electric wire, the electric wire including the core made of a metallic material and an insulation layer covering the core, the exposed portion of the core being exposed by removing the insulation layer at a terminal of the electric wire; and an insulation layer covering portion configured to cover the insulation layer of the electric wire, wherein the intermediary cap is configured to be crimped to the core without a water-proof measure between the intermediary cap and the core by a terminal fitting configured to be attached to the terminal of the electric wire and made of a metallic material other than the metallic material of the core, wherein the intermediary cap has conductivity, and wherein the intermediary cap is made of a metallic material having a value of a standard electrode potential between a value of a standard electrode potential of the core and a value of a standard electrode potential of the terminal fitting.

5. The intermediary cap according to claim 4, further comprising a multilevel portion formed between the core covering portion and the insulation layer covering portion, the multilevel portion having a diameter gradually enlarged from the core covering portion toward the insulation layer covering portion.

6. The intermediary cap according to claim 4, further comprising a multilevel portion formed between the core covering portion and the insulation layer covering portion, the multilevel portion is orthogonal to the core covering portion and the insulation layer covering portion.

7. The intermediary cap according to claim 4, wherein the core covering portion has a diameter smaller than the diameter of the insulation layer covering portion.

8. The intermediary cap according to claim 4, wherein the intermediate cap is formed into a cylinder having a closed distal end side formed in such a manner as to cover a range from the core of the electric wire to a part of the insulation layer of the electric wire.

9. The intermediary cap according to claim 4, wherein the metallic material of the intermediary cap comprises one of: iron or iron alloy, nickel or nickel alloy, and zinc or zinc alloy.

10. The intermediary cap according to claim 4, wherein the core is made of aluminum or aluminum alloy, the terminal fitting is made of copper or copper alloy, and the intermediary cap is made from a metal configured to avoid contact between the aluminum or aluminum alloy of the core and the copper or copper alloy of the terminal fitting.

11. The intermediary cap according to claim 10, wherein the intermediary cap is made from a metal configured to minimize the potential difference based on the standard electrode potential, between the standard electrode potential of the core and the standard electrode potential of the terminal fitting to suppress electric corrosion between the core and the intermediary cap and to improve the reliability of conductivity between the core and the terminal fitting.

12. The electric wire terminal connection structure according to claim 1, wherein the metallic material of the intermediary cap comprises one of: iron or iron alloy, nickel or nickel alloy, and zinc or zinc alloy.

13. The electric wire terminal connection structure according to claim 1, wherein the core is made of aluminum or aluminum alloy, the terminal fitting is made of copper or copper alloy, and the intermediary cap is made from a metal configured to avoid contact between the aluminum or aluminum alloy of the core and the copper or copper alloy of the terminal fitting.

14. The electric wire terminal connection structure according to claim 13, wherein the intermediary cap is made from a metal configured to minimize the potential difference based on the standard electrode potential, between the standard electrode potential of the core and the standard electrode potential of the terminal fitting to suppress electric corrosion between the core and the intermediary cap and to improve the reliability of conductivity between the core and the terminal fitting.

15. The electric wire terminal connection structure according to claim 3, wherein the intermediary cap further comprises a multilevel portion formed between the core covering portion and the insulation layer covering portion, the multilevel portion having a diameter gradually enlarged from the core covering portion toward the insulation layer covering portion.

16. The electric wire terminal connection structure according to claim 3, wherein the intermediary cap further comprises a multilevel portion formed between the core covering portion and the insulation layer covering portion, the multilevel portion is orthogonal to the core covering portion and the insulation layer covering portion.

* * * * *